US005226797A

United States Patent [19]

Da Costa

[11] Patent Number: 5,226,797

[45] Date of Patent: Jul. 13, 1993

[54] ROLLING PISTON COMPRESSOR WITH DEFINED DIMENSION RATIOS FOR THE ROLLING PISTON

[75] Inventor: Caio Mario Franco Da Costa, Joinville, Brazil

[73] Assignee: Empressa Brasielira De Compressores S/A-EMBRACO, Joinville, Brazil

[21] Appl. No.: 717,691

[22] Filed: Jun. 19, 1991

Related U.S. Application Data

[63] Continuation-in-part of Ser. No. 546,296, Jun. 29, 1990, abandoned.

[30] Foreign Application Priority Data

Jun. 30, 1989 [BR] Brazil ..... PI 8903352

[51] Int. Cl.[5] ..... F04C 18/356; F04C 29/02

[52] U.S. Cl. ..... 418/63; 418/94; 418/96; 418/150

[58] Field of Search ..... 418/63, 94, 150, 91, 418/98, 96, 99

[56] References Cited

U.S. PATENT DOCUMENTS

| | | | |
|---|---|---|---|
| 2,669,384 | 2/1954 | Dills | 418/63 |
| 4,265,605 | 5/1981 | Ito | 418/63 |
| 4,624,630 | 11/1986 | Hirahara et al. | 418/63 |
| 4,626,180 | 12/1986 | Tagawa et al. | 418/63 |
| 4,676,726 | 6/1987 | Kawaguchi et al. | 418/63 |

FOREIGN PATENT DOCUMENTS

| | | | |
|---|---|---|---|
| 2508287 | 9/1975 | Fed. Rep. of Germany | 418/63 |
| 133801 | 12/1951 | Sweden | 418/63 |
| 2195401 | 4/1988 | United Kingdom . | |

*Primary Examiner*—John J. Vrablik

*Attorney, Agent, or Firm*—Darby & Darby

[57] ABSTRACT

The invention refers to a hermetic compressor with rotary rolling piston, of the type of high internal pressure inside the shell (1) and small displacement volume, and with its cylindrical chamber, internal to the cylinder block (4), being internally divided by the rolling piston (50,500) and by a sliding vane (9), into suction and discharge chambers with internal pressure being considerably lower than the internal pressure of the shell during most of the rolling piston (50,500) operating cycles. An axial gap for the passage of lubricant oil is provided between the annular faces of the rolling piston (50,500) and the axial end walls (10*a*, 20*a*) of the cylindrical chamber. The rolling piston (50,500) presents an external diameter/internal diameter relation of about 1.63 up to 2.22, in order to increase the radial path of the lubricant oil through said axial gaps.

6 Claims, 5 Drawing Sheets

ROLLING PISTON COMPRESSOR WITH DEFINED DIMENSION RATIOS FOR THE ROLLING PISTON

This application is a continuation -in-part of application Ser. No. 07/546,296, filed Jun. 29, 1990, now abandoned.

FIELD OF THE INVENTION

The present invention relates to a rotary hermetic compressor of the rolling piston type and of high internal pressure in the shell, low back pressure and small displacement volume, which is normally used in small refrigerating machines.

By rotary rolling piston hermetic compressor with high internal pressure, it should be understood that one whose shell is submitted to the condensing pressure of the system in which it is used (the so called "high side" compressor).

BACKGROUND OF THE INVENTION

In rotary rolling piston hermetic compressors with low back pressure and high internal pressure in the shell, it occurs the phenomenon of the passage (penetration) of the lubricating oil to the interior of the cylinder, into the suction and the discharge chambers.

The oil contained at the bottom of the shell and submitted to the high gas pressure inside the shell, will be elevated by an oil pump or another device, until it reaches the crankshaft, from which the oil is then radially displaced through the gaps between the annular end faces of the rolling piston and the bearing covers, entering the cylinder internal chambers.

This penetration of oil at a high temperature into the cylinder causes on the functioning and performance of the compressor the effects discussed hereinafter.

On penetrating into the suction chamber, the oil, at a high temperature, warms up the incoming suction gas, causing an increase of its specific volume and, therefore, reducing the suction chamber filling up capacity. Thus, the gas mass which fills the cylinder suction chamber is reduced by the effect of the increase of the gas specific volume. Besides this inconvenience, it should be noted that the oil volume itself which penetrates in the suction chamber takes gas filling space; however, this effect is of a quite secondary importance in relation to the heating effect.

The above mentioned problem causes a decrease in the compressor pumping capacity as a result of the lubricating oil penetration into the cylinder.

In turn, on penetrating into the cylinder compression chamber, the oil will be, during a great part of the compression period, at a higher temperature than the gas temperature under compression, also causing the heating of such gas and increasing its specific volume. This phenomenon results in an increase in the work required for compressing the gas and, consequently, an increase in the compressor energy consumption. This fact can be verified in FIG. 2 of the accompanying drawings, where a pressure X angle of rotation diagram is presented for demonstrating that the compression pressure raises faster when the oil leakage to the interior of the compression chamber increases as represented by the dashed line Q.

These two effects when combined, contribute to considerably drop the compressor volumetric and energy efficiency.

On the other hand, the presence of the lubricating oil flow carries out two favorable functions which are fundamental to the compressor functioning.

The first one, and the most obvious one, is the lubrication of the movable parts involved.

The second one is the sealing of all clearances between the movable parts, thus avoiding the gas direct leakage from the interior of the cylinder to the interior of the shell, which leakage, in case of happening, can be even more prejudicial to the compressor, in terms of capacity drop, than the gas overheating by the oil.

This property of the oil of sealing gaps between the movable parts, acts on the cylinder internal leakages (from the compressor chamber to the suction chamber at low pressure), and on the leakages from the compression chamber to the interior side of the shell.

In the more specific case of the oil which penetrates radially into the cylinder through the rolling piston end faces, the lubricating oil prevents the gas from leaking from the compression chamber to the crankshaft internal parts and from the latter to the interior of the shell.

Therefore, the amount of oil which gets into the cylinder must be controlled at an optimum level, i.e., at a minimum level in order to make possible to have the sealing of the gas leakages and, at the same time, only a minimum gas heating in the interior of the cylinder.

A well-known way to control the amount of oil that penetrates into the cylinder, by the gaps of the rolling piston end faces, is to reduce such gaps up to a minimum level in which the losses by friction between the rolling piston end faces and the bearing cover faces do not reach such a value to completely cancel the gains resultant from the oil flow reduction through said gaps.

Despite the possibility of reducing the rolling piston end gaps in a way to get an advantageous reduction in the amount of lubricating oil which penetrates into the cylinder, the obtained gain, in terms of energetic efficiency of the compressor, will always be inferior to what would be reached by the exclusive reduction of the oil flow, due to greater friction loss as a result of minor or greater reduction of the said gaps.

In the development of the present invention, it was found out that an increase in the radial path of the lubricant oil flow through the opposite axial gaps of the rolling piston makes it possible to reduce, by at least 10%, the oil flow to the interior of the suction and discharge chambers, without substantially increasing the friction losses between the movable parts.

From the equation that models the radial flow of oil through the rolling piston end faces (viscous flow between parallel discs) it can be noted that the flow is controlled by the gap ($\delta R$) and by the thickness of the rolling piston wall or, more precisely, by the relation:

$$\left[\frac{1}{\ln \frac{\text{ext.}\phi}{\text{int.}\phi}}\right]$$

The behavior of such function can be observed in the graph of FIG. 3. The rolling piston dimensions found in the presently marketed compressors with small displacement volume present an external diameter (ext. $^{100}$)/internal diameter (int. $\phi$) relation between 1.40 and 1.55, defining rolling pistons of thin walls.

The invention aims to define as rolling pistons of thick wall those which present the external diameter-/internal diameter relation $\geqq 1.63$, approximately.

It can be noticed by the graph of FIG. 3 that, below about the value of external diameter/internal diameter=1.63, the slope of curve $\ln^{-1}$ external diameter/internal diameter is quite accentuated, becoming gradually less steep after said value has reached about 1.6.

It should be remembered that the behavior of the curve that represents the oil flow toward the interior of the cylinder is proportionally reflected in the compressor performance already explained, i.e., the greater the value of the function $\ln^{-1}$ (external diameter/internal diameter), the greater will be the oil flow and worse the volumetric and energy efficiency of the compressor. Therefore, it is important to notice that the penetration of oil inward the cylinder can have a reduction of at least 10% with a dimensioning of the rolling piston diameters in a way to get a relation (external diameter/internal diameter) from 1.63 on, regarding the range commonly used, the rolling piston being dimensioned in order to get a relation of external diameter/internal diameter $\geqq 1.63$, approximately.

It is also important to mention that diameter relations of 1.63 on, up to nearly 2.22 are perfectly feasible in the production processes normally used for rotary rolling piston compressors and yet, there is no impediment or disadvantage in terms of the compressor performance when using such relations.

One possible disadvantage would be the increase of friction losses between the piston faces and the cylindrical chamber end walls due to the increase of the contact surface. However, the increase of the friction losses does not effectively occur because, with the increase of the contact surface, there is a tendency to have a reduction of the angular velocity of the piston over its own shaft which compensates the loss. Besides, such loss by friction is of the order of magnitude at least one time smaller than the losses caused by the heated oil, when the gap $\delta R$ is the usual one. Therefore, such loss could be neglected anyway.

It was also observed that certain prior art rotary hermetic compressors with high displacement volume (higher than about 7 cc) and/or low internal pressure in the shell (low side compressor) present external diameter/internal diameter relations for the rolling piston within the range of 1.63 to 2.22. However, the existance of rotary hermetic compressors with high displacement volume and/or low internal pressure in the shell having such dimensional relation is merely casual. There is not any technical literature suggesting the use of said dimensional relation to obtain a reduction of the oil flow to the interior of the suction and discharge chambers.

According to the available technical literature, it can be affirmed that the fact of existing rotary hermetic compressors presenting said dimensioning relation is a simple consequence of the fact that the displacement volume, which was designed to correspond to a preset capacity, is high (higher than 7.1 cc), thus making high the values of the cylinder and rolling piston radii, whereas the shaft radius is determined by its minimum possible value, due to the strength of the material which is used. In other words, it can be said that in hermetic compressors with high displacement volume, the shaft radius is small enough to allow a relatively small radius for the eccentric and, consequently, an also small internal radius for the rolling piston. Thus, the external diameter/internal diameter relation of the rolling piston can be situated within the above mentioned range only casually.

Although there are rotary hermetic compressors with a rolling piston presenting a thick wall, it should be noted that such compressors are of the "low-side" type (low internal pressure in the shell). Nevertheless, there are fundamental differences regarding the finality and functioning of a thick rolling piston in a "high-side" (high internal pressure in the shell) hermetic compressor and in a "low-side" hermetic compressor (low internal pressure in the shell). In the low-side compressor, the low internal pressure in the shell does not act on the oil which, therefore, it is not allowed to reach the interior of the cylinder through the gaps between the movable parts, as it occurs in the high-side compressor. Thus, in the low-side compressor, the oil does not act as a sealant against the gas leakages through the gaps, the compressed gas in the compression chamber tending to leak through the gaps between the movable parts, more specifically between the rolling piston end faces and the bearing covers. The flow in said gaps is, therefore, of gas leakage in the low-side compressor, and not of oil penetration as it occurs in the high-side compressors.

Reducing the gaps or increasing the rolling piston thickness in the low-side compressors has the finality of avoiding the gas leakage in the compression chamber, and not of controlling the problem of oil flow to the interior of the cylinder, as it occurs in the high-side compressors. Thus, the finality of increasing the thickness of the rolling piston in both types of compressors is completely different.

As the internal diameter of the rolling piston is approximately the same as the diameter of the eccentric portion of the crankshaft, the desired relation can be represented as follows (see FIG. 4B):

$$1.63 \leqq \frac{RR}{Rr}\left(\text{or } \frac{RR}{Re}\right) \leqq 2.22 \qquad (1)$$

where:

RR=external radius of the rolling piston

Rr=internal radius of the rolling piston

Re=radius of the crankshaft eccentric portion

As the external radius RR of the rolling piston is determined in relation to the cylinder diameter that is designed for the compressor, the relation (1) above can be achieved by changing the values of the piston internal radius Rr and, consequently, the radius Re of the crankshaft eccentric portion.

In the known rotary hermetic compressors (having a displacement volume above 7 cc), presenting the dimensional relation (1) above, the internal radius Rr of the rolling piston (or radius Re of the crankshaft eccentric portion) is generally large enough to allow the following dimensional relation:

$$Rr \approx Re = Ec + Rs \qquad (2)$$

where:

Ec=eccentricity of the eccentric portion

Rs=radius of the compressor shaft

The dimensional relation (2) above is shown in FIG. 4A, though this prior art solution does not necessarily present the dimensional relation (1) simultaneously.

When the compressor presents the dimensional relation (2) above, the radius Rm of the shaft end portion can be maintained equal to the radius Rs of the crankshaft, i.e., Rm=Rs, without causing any problem of assembling the rolling piston on the eccentric portion of the crankshaft, as illustrated in FIG. 4A, where the contour of the eccentric portion is tangent to the crankshaft remainder contour.

Nevertheless, in the rotary hermetic compressors with small displacement volume (less than 7 cc) and high internal pressure in the shell, the reduction of the internal radius Rr of the piston (or radius Re of the eccentric portion), in order to achieve a radial extension of the piston wall within the relation (1), can make it impossible to have, due to the eccentricity Ec required in the compressor design and to the minimum diameter required for the shaft, both dimensional relations (1) and (2) simultaneously. In these prior art compressors, the dimensional relation (1) can only be obtained in conjunction with the following dimensional relation (FIG. 4b):

$$2Rr < Rm + Ec + Re \quad (3)$$

In this situation, the contour of the crankshaft eccentric portion is not tangent to the crankshaft contour anymore, becoming secant to the latter, avoiding that the rolling piston be mounted at the crankshaft eccentric portion.

SUMMARY OF THE INVENTION

Thus, it is an object of the present invention to provide a rotary rolling piston hermetic compressor with high internal pressure in the shell and small displacement volume (less than about 7 cc), which presents a lubricant oil flow to the interior of the cylinder, considerably reduced in relation to the known solutions, without causing any substantial increase of friction between the compressor movable parts, more specifically between the rolling piston end faces and the bearing covers and between the piston and the eccentric portion of the driving crankshaft.

The hermetic compressor with rotary rolling piston, of small displacement volume and low back pressure comprises: a hermetic shell submitted to high pressure; a cylinder block that is housed inside the shell and has an internal cylindrical chamber; a crankshaft having an eccentric portion which is close to an end portion of the crankshaft; a rolling piston which is assembled around the eccentric portion of the crankshaft, in order to rotate inside the cylindrical chamber; end walls that close the opposite axial ends of the cylindrical chamber, said chamber being internally divided by the rolling piston in a suction chamber, whose internal pressure is substantially lower than the internal pressure of the shell, and in a compression chamber presenting an internal pressure substantially lower than the internal pressure of the shell during most of the compression cycle; and an axial gap for the passage of lubricant oil between said end walls of the cylindrical chamber and the opposite end faces of the rolling piston.

According to the present invention, the rolling piston is built in order to simultaneously present the following dimensional relations:

$$1.63 \leq \frac{RR}{Rr} \leq 2.22 \quad (1)$$

$$2Rr > Rm + Ec + Re \quad (4)$$

where:

Ec = eccentricity of the eccentric portion
Re = radius of the eccentric portion
RR = external radius of the rolling piston
Rr = internal radius of the rolling piston
Rm = radius of the crankshaft end portion
Rs = radius of the crankshaft so as to increase the radial path of the lubricant oil through said axial gaps.

In the cases where the diameter of the shaft, together with the dimensional relations (1) and (4) above, allow the relation:

$$Rr \approx Re = Rs + Ec \quad (2)$$

Re differs from Rr by the required radial clearance between the eccentric portion and the rolling piston needed for assembly. This is usually about 10 to 30 um.

The assembly of the rolling piston to the eccentric portion of the crankshaft can be made by maintaining Rm = Rs, with the contour of the eccentric portion being kept external and tangent at a point in relation to the contour of the crankshaft.

In the cases where the dimensional relations (1) lead to the relation:

$$Rr \approx Re < Rs + Ec \quad (5)$$

the mounting of the rolling piston to the eccentric portion of the crankshaft can only be made by reducing the diameter of the crankshaft end portion so as to have Rm < Rs and make possible the dimensional relation (4). In this situation, the contour of the crankshaft eccentric portion is secant in relation to the crankshaft.

In another embodiment of the invention, the crankshaft end portion is not provided with a bearing. In this case, the axial end wall of the cylindrical chamber faces the crankshaft body and is defined by the plate of a respective bearing that is attached to the cylinder block, whereas the opposite axial end wall is defined by a plate which is attached to the adjacent face of the cylinder block. In this constructive solution, the rolling piston is designed in such a way to present the dimensional relation (1).

BRIEF DESCRIPTION OF THE DRAWINGS

The invention will hereinafter be described, with reference to the appended drawings, in which.

DETAILED DESCRIPTION OF THE INVENTION

Figure 1A:
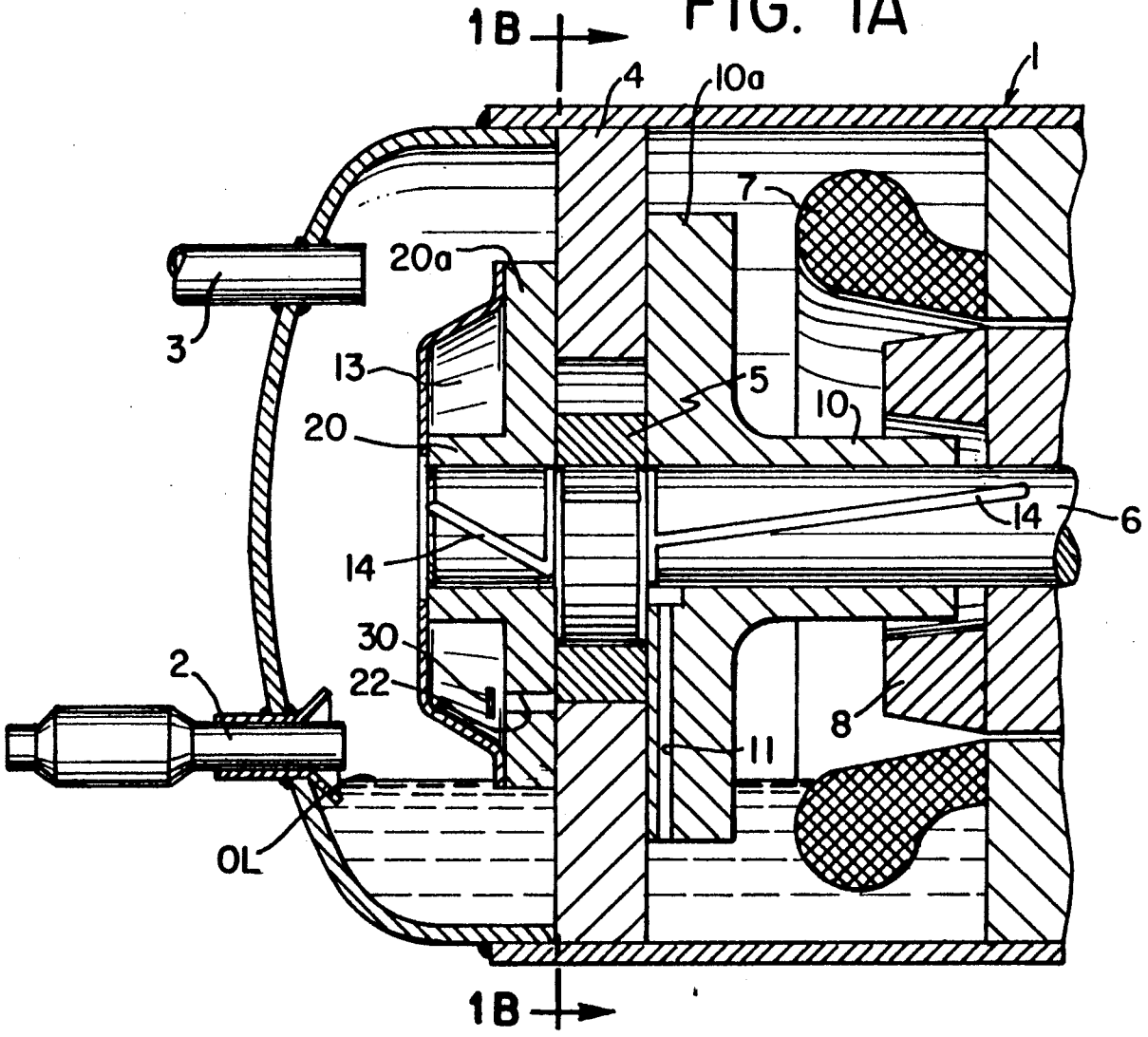
FIG. 1A shows a partial longitudinal section view of a rolling piston rotary compressor of the type used in the present invention.
Figure 1B:
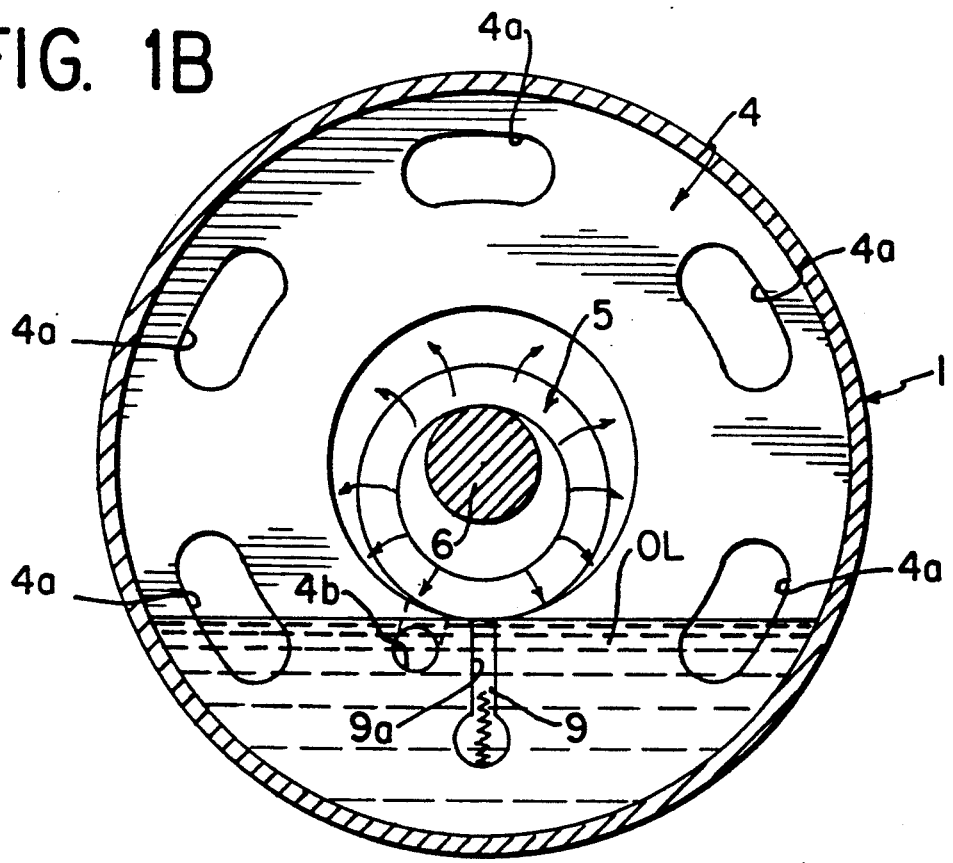
FIG. 1B shows a cross sectional view, taken according to line 1B—1B of FIG. 1A.
Figure 2:
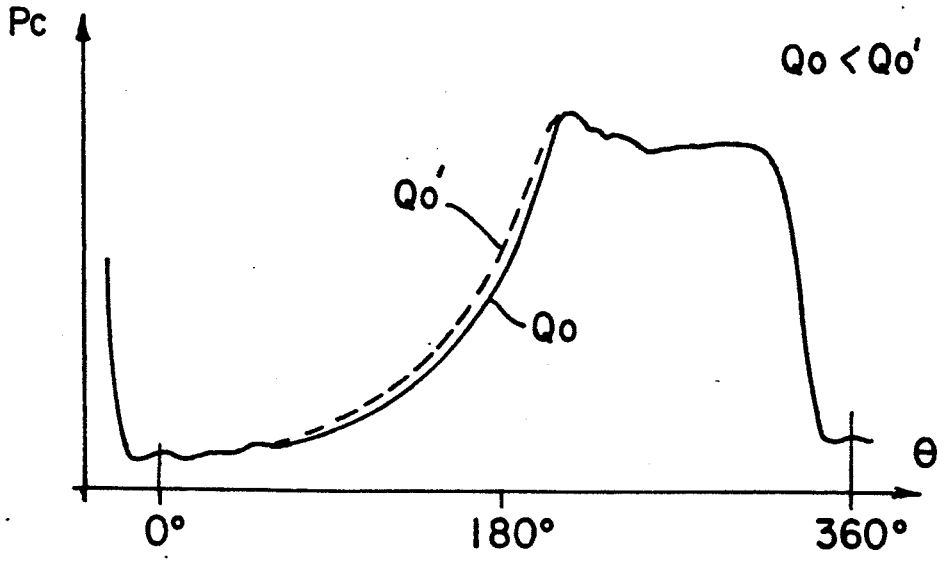
FIG. 2 shows a diagram of the compression pressure produced in terms of the rotation angle of the rolling piston.
Figure 3:
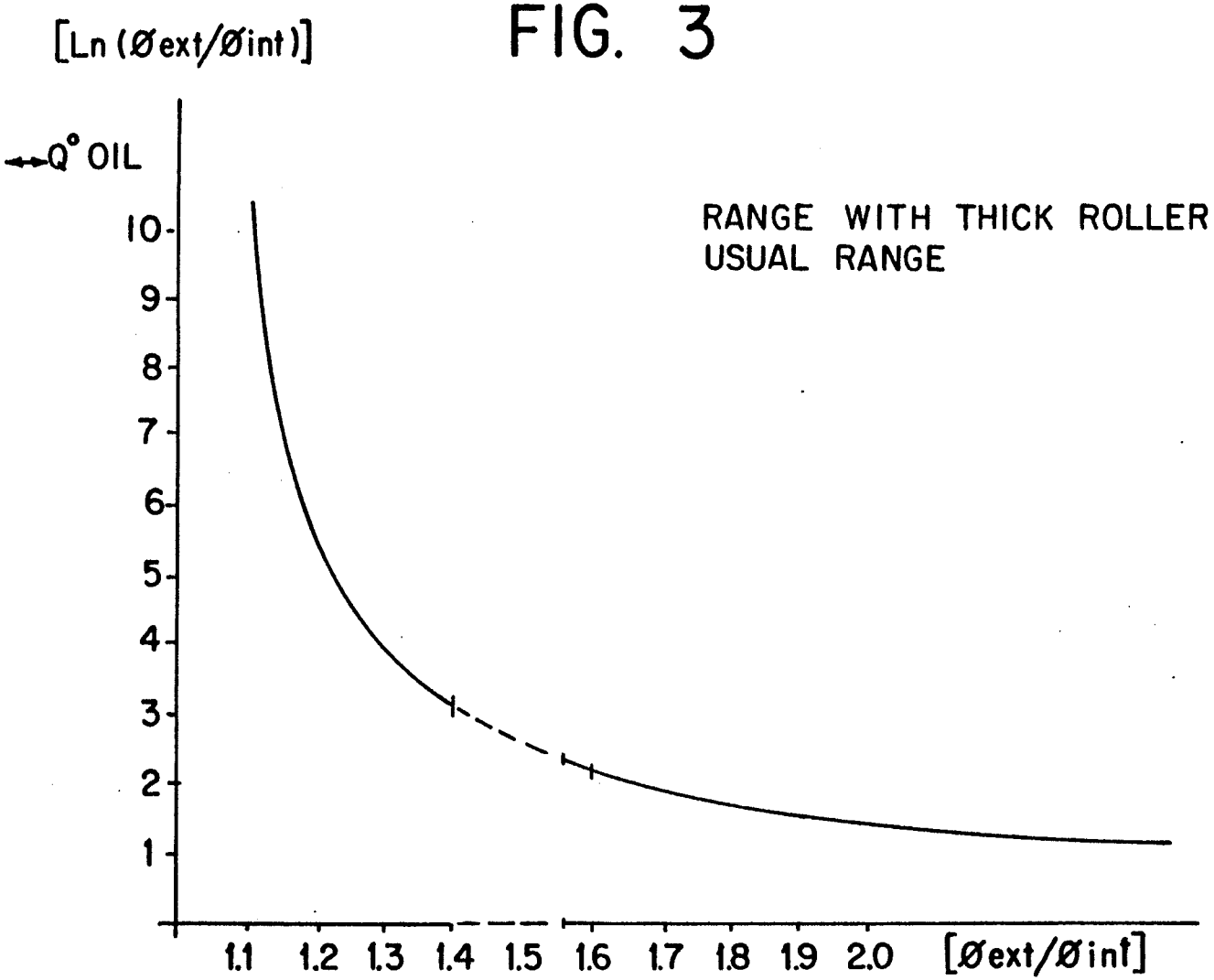
FIG. 3 illustrates a representative graph of the function of oil radial flow through the rolling piston faces X the thickness of the piston annular wall.

According to FIGS. 1A and 1B, the compressor of the present invention includes a shell 1 fastening suction 2 and discharge 3 tubes and housing a cylinder block 4, in whose interior a cylindrical chamber is defined which houses a rolling piston 5 that is mounted on a crankshaft 6 driven by an electric motor composed by a stator 7 and a rotor 8. This compressor is of the type which presents high internal pressure in the shell, low back pressure and small displacement volume. Inside the shell, an inlet end of the discharge tube 3 is opened.

The crankshaft 6 is supported on a main bearing 10 and a sub-bearing 20, each one embodying a plate or flange 10*a* and 20*a* fixed against one of the axial end faces of the cylinder block 4, in a way to define the cylindrical chamber walls in which interior the rolling piston 5 is displaced.

In the illustrated example, a discharge muffler chamber 13 is provided next to the sub bearing 20 external face, so as to receive the compressed gas inside the cylinder, the sub bearing plate 20*a* (or the cylinder block wall 4 in case of absence of such bearing) being provided with an orifice 22, with its outlet end defining an annular valve seat against which is seated a known reed valve 30 internal to the discharge muffler chamber 13.

Still according to the basic construction illustrated in FIGS. 1A and 1B, the main bearing plate 10*a* is provided with a radial channel 11 with its lower end being immersed in the lubricating oil OL stored at the bottom of the shell 1 and with its upper end being opened to an oil pump or another pumping device, defined around the crankshaft 6 and in fluid communication with longitudinal superficial grooves 14 provided along the crankshaft 6, in order to conduct the lubricating oil to the bearing and to the axial gaps of the rolling piston 5.

As illustrated in FIG. 1B, the cylinder block 4 presents windows 4*a* for internal pressure balance in the shell and for lubricating oil passage and also, a slot where a sliding vane 9 is incased which, together with the external cylindrical face of the rolling piston 5, divides the cylindrical chamber into a suction chamber and a discharge chamber, the first one being fed through a channel 4*b* made on the cylinder block and maintained in communication with the internal end of the suction tube 2.

Figure 4A:
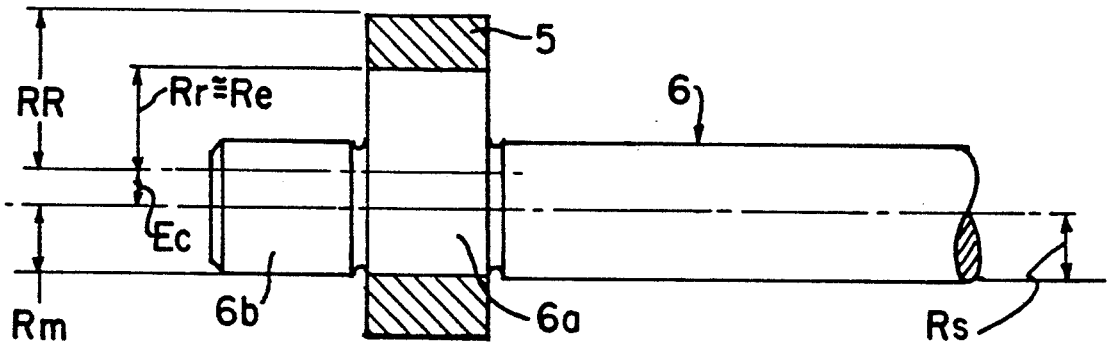
FIG. 4A PRIOR ART
FIG. 4A illustrates a side view of the crankshaft rolling piston set of the prior art.

FIG. 4A illustrates a conventional construction of a crankshaft 6 including an eccentric portion 6*a* for driving the rolling piston 5 and an end portion 6*b* for journalling inside the sub bearing 20; usually, this specific crankshaft portion has the same diameter of the rest of the crankshaft body. In this solution of the prior art, corresponding to the arrangement illustrated in FIG. 1B, the rolling piston 5 presents an annular wall thickness according to the relation RR/Rr<1.60, making the oil path, represented by the arrows in FIG. 1B, be short enough to allow a prejudicial amount of lubricant oil to penetrate inside the cylinder.

Figure 4B:
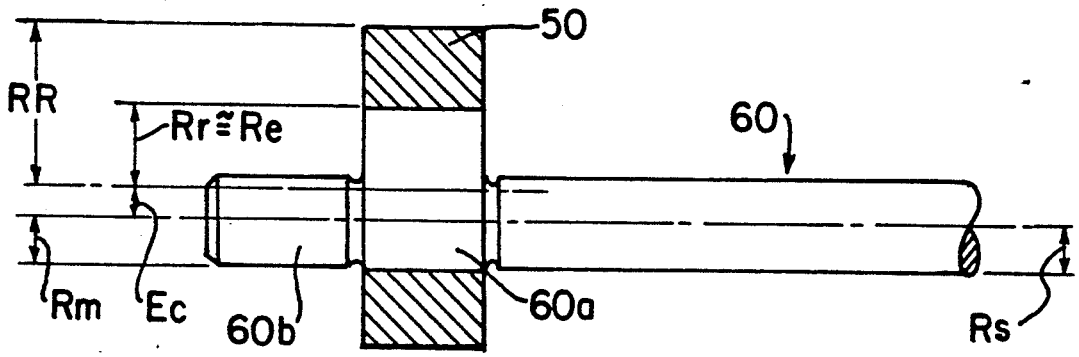
FIG. 4B illustrates a side view of the crankshaft rolling piston set built according to a first embodiment of the invention, in which the dimensional relation (1) is obtained by reducing the internal radius of the rolling piston and the diameter of the whole shaft.

FIG. 4B illustrates a crankshaft 60 with its eccentric portion 60*a* driving a rolling piston 50 with annular wall thickness according to a relation RR/Rr>1.63. This dimensional relation was reached by reducing the diameter of the entire crankshaft 60, jointly with a corresponding reduction of the internal diameter of the rolling piston 50 and, consequently, of the eccentric portion 60*a*. In this particular case, it was possible to reduce the diameter of the crankshaft 60 (including its end portion 60*b*), in order to maintain the dimensional relations:

$$\frac{RR}{Rr} \geqq 1.63 \quad (1)$$

$$2\,Rr > Rm + Ec + Re$$
$$Rs = Rm \quad (4)$$

Figure 4C:
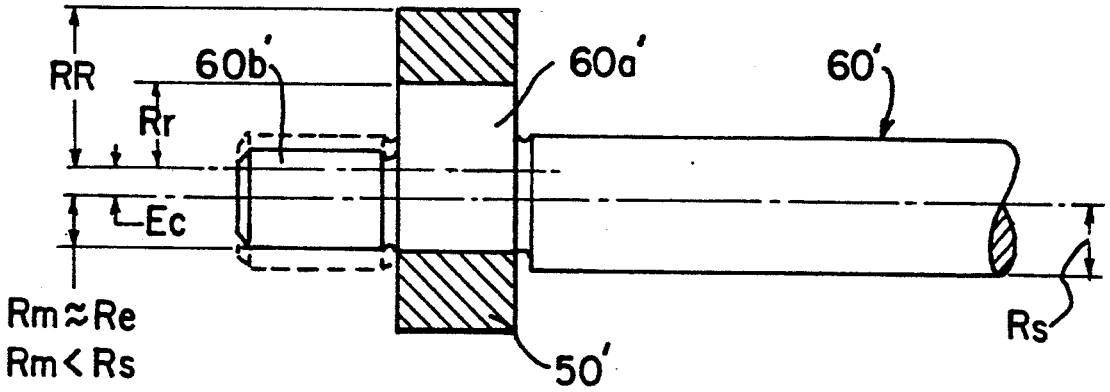
FIG. 4C shows the set of the previous figure as adapted to a second embodiment of the invention, in which a diametral reduction is made at the end portion of the shaft, in order to achieve the diametral relation (1)

FIG. 4C illustrates a crankshaft 60', with its eccentric portion 60*a*' driving a rolling piston 50' having an annular wall thickness according to the relation RR/Rr>1.63. This dimensional relation, which is also within the limits defined in the present invention, was reached by reducing the internal diameter (2 Rr) of the rolling piston 50' and, consequently, the diameter of the eccentric portion (2 Re) 60*a*'. In this case, the reduction of the shaft diameter (2 Rs) is not possible, for example, due to design reasons, and the reduction of the eccentric portion 60*a*' may lead the set to the following dimensional relations:

$$Re < Rs + Ec \quad (5)$$

If the Rm value is kept the same as the Rs value (Rm=Rs as in FIG. 4B), the following undesirable relation will occur:

$$2Rr < Rm + Ec + Re \quad (3)$$

indicating a condition in which the internal diameter of the rolling piston 50' is smaller than the joint contour of the eccentric portion 60*a*' and the end portion 60*b*' of the crankshaft 60' (in this case, the shaft end portion is kept with the same diameter as the crankshaft; see dashed lines in FIG. 4C.). Thus, as illustrated in FIG. 4C, the diameter (2 Rm) of the end portion 60*b*' of the crankshaft 60' is reduced so as to achieve the following dimensional relation:

$$\frac{RR}{Rr} \geqq 1.63 \quad (1)$$

$$2\,Rr > \sim Rm + Ec = Re \quad (4)$$

where Rm<Rs.

Figure 4D:
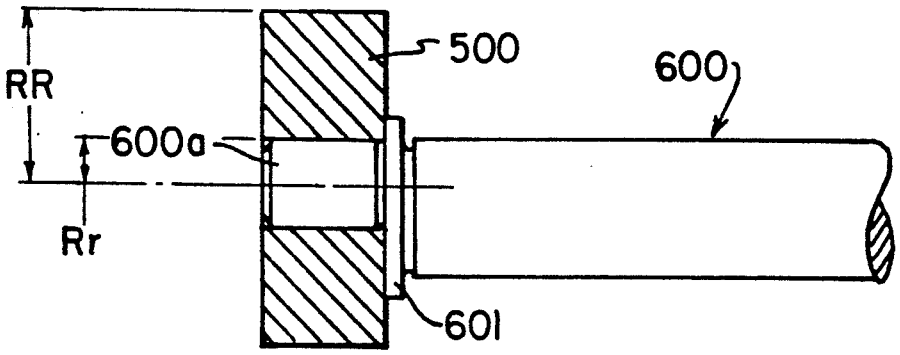
FIG. 4D shows a similar view to that of FIG. 4C, but illustrating said set according to another embodiment of the invention.
Figure 5:
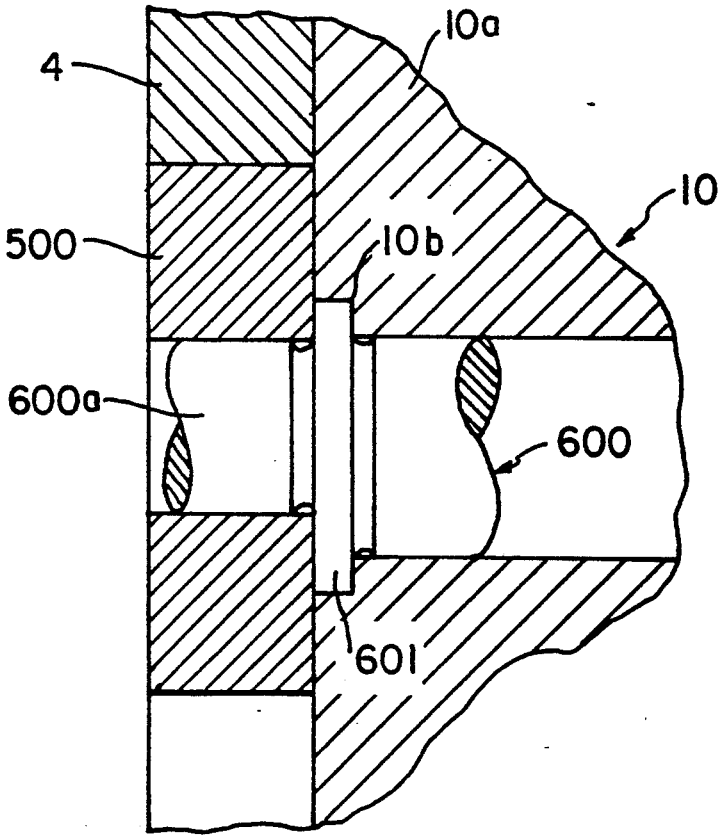
FIG. 5 shows an enlarged view of part of the set of FIG. 4D, when disposed inside the bearing and the cylinder block.

FIG. 4D illustrates another possible construction for the crankshaft 600 which, as a result of the large thickness of the rolling piston 500 wall, presents an eccentric portion 600*a* with a very reduced diameter, the end portion having also been completely eliminated and, consequently, the sub bearing 20 as well. In this case, the corresponding axial end wall of the cylindrical chamber can be defined by a simple closing plate which is fastened to the adjacent face of the cylindrical block.

In the case of the constructive solution illustrated in FIG. 4D, an axial stop 601 in the shape of an annular flange incorporated to the crankshaft 600 body is provided. Said stop is placed next to its eccentric portion 600*a* in a way to be housed in a respective recess 10*b* made on the end face of the plate 10*a* of the main bearing 10, in order to limit the crankshaft 600 axial displacement towards the motor, caused by its rotor magnetic force actuating upon said shaft. The recess 10*b* becomes to work as axial bearing to the stop 601, allowing with its deepness the formation of a big gap between the axial stop 601 and the adjacent end wall of the rolling piston.

It should be observed that, in this last embodiment, the wall thickness of the rolling piston 500 is kept within the dimensional relation (1) mentioned above.

I claim:

1. Hermetic compressor of low back pressure, comprising:

a hermetic shell that is subjected to a high internal pressure and contains lubricating oil;

a cylinder block housed inside the shell, having an internal cylindrical chamber;

a crankshaft having an eccentric portion;

a rolling piston assembled around the eccentric portion of the crankshaft to rotate inside the cylindrical chamber;

end walls closing the opposite axial ends of the cylinder block cylindrical chamber, said chamber being internally divided by the rolling piston into a suction chamber, whose internal pressure is substantially lower than the internal pressure of the shell, and a compression chamber, presenting an internal pressure that is substantially lower than the internal pressure of the shell during most of the compression cycle; and an axial gap for the passage of lubricant oil between one of said end walls of the cylindrical chamber and the opposite face of the rolling piston, the crankshaft having its end with the eccentric portion in the cylinder block, the axial end wall of the cylindrical chamber adjacent to said end of the crankshaft being defined by a plate which is attached to the adjacent face of the cylinder block, the opposite axial end wall of the cylindrical chamber being defined by the plate of a respective bearing fastened to the cylinder block, said compressor having a displacement volume less than 7.1 cc; the rolling piston having the following dimensional relation:

$$1.63 \leqq \frac{RR}{Rr} \leqq 2.22 \qquad (1)$$

where

RR=external radius of the rolling piston

Rr=internal radius of the rolling piston to increase the radial path of the lubricant oil through said axial gaps and to reduce the oil flow to the interior of the cylinder chamber.

2. Hermetic compressor, according to claim 1, wherein the crankshaft has adjacent to its eccentric portion a peripheral annular flange which is housed in a respective recess provided on the end face of the plate of the bearing.

3. Hermetic compressor with rotary rolling piston, of low back pressure, comprising:

a hermetic shell that is subjected to a high internal pressure and contains lubricating oil;

a cylinder block inside the shell and having an internal cylindrical chamber;

a crankshaft having an eccentric portion near an end thereof;

a rolling piston assembled around the crankshaft eccentric portion to rotate inside the cylindrical chamber;

end walls enclosing the opposite axial ends of the cylinder block cylindrical chamber, said chamber being internally divided by the rolling piston into a suction chamber, whose internal pressure is substantially lower than the internal pressure of the shell, and a compression chamber presenting an internal pressure substantially lower than the internal pressure of the shell during most of the compression cycle;

an axial gap for the passage of lubricant oil between an end wall of the cylindrical chamber and the opposite end face of the rolling piston, said compressor having a displacement volume less than 7.1 cc,;

the rolling piston having the following dimensional relations:

$$1.63 \leqq \frac{RR}{Rr} \leqq 2.22 \qquad (1)$$

$$2Rr > Rm + Ec + Re \qquad (4)$$

where:

Ec=eccentricity of the rolling piston eccentric portion

Re=radius of the rolling piston eccentric portion

RR=external radius of the rolling piston

Rr=internal radius of the rolling piston

Rm=radius of the crankshaft end portion

Rs=radius of the crankshaft to increase the radial path of the lubricant oil through said axial gap and to reduce the oil flow to the interior of the cylinder chamber.

4. Hermetic compressor, according to claim 3, wherein the rolling piston and crankshaft set have the following further dimensional relations:

$$Rr \approx Re \approx Rs + Ec$$

$$Rm = Rs \qquad (2)$$

the contour of the eccentric portion of the crankshaft being external and tangent to the contour of the crankshaft.

5. Hermetic compressor, according to claim 3, wherein the rolling piston and crankshaft set have the following further dimensional relations:

$$Rr \approx Re < Rs + Ec$$

$$Rm < Rs \qquad (5)$$

the contour of the eccentric portion of the crankshaft being secant to the contour of the crankshaft.

6. Hermetic compressor, according to claim 3, wherein the axial end walls of the cylindrical chamber are each defined by the plate of a respective bearing which is fastened to the cylinder block.

* * * * *